US009310706B2

(12) United States Patent
Ishizumi et al.

(10) Patent No.: US 9,310,706 B2
(45) Date of Patent: Apr. 12, 2016

(54) IMAGE FORMING APPARATUS

(71) Applicant: CANON KABUSHIKI KAISHA, Tokyo (JP)

(72) Inventors: Keisuke Ishizumi, Hiratsuka (JP); Shinsuke Kobayashi, Yokohama (JP); Ken Nakagawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 11 days.

(21) Appl. No.: 14/096,518

(22) Filed: Dec. 4, 2013

(65) Prior Publication Data

US 2014/0161494 A1 Jun. 12, 2014

(30) Foreign Application Priority Data

Dec. 6, 2012 (JP) ..... 2012-267470

(51) Int. Cl.
*G03G 15/00* (2006.01)
*G03G 15/01* (2006.01)

(52) U.S. Cl.
CPC ..... *G03G 15/0189* (2013.01); *G03G 15/5041* (2013.01); *G03G 15/5058* (2013.01); *G03G 2215/0161* (2013.01)

(58) Field of Classification Search
USPC ..... 399/49
See application file for complete search history.

(56) References Cited

U.S. PATENT DOCUMENTS

2014/0072317 A1* 3/2014 SHUKUYA et al. ..... 399/49

FOREIGN PATENT DOCUMENTS

| | | | |
|---|---|---|---|
| JP | 2006-047357 | A | 2/2006 |
| JP | 2010-072327 | A | 4/2010 |
| JP | 2010-197586 | A | 9/2010 |
| JP | 2012-027254 | A | 2/2012 |
| JP | 2012-137733 | A | 7/2012 |

OTHER PUBLICATIONS

JP2012027254 A Machine Translation available from JPO website.*
JP2012137733 A Machine Translation available from JPO website.*
JP2010072327 A Machine Translation available from JPO website.*

* cited by examiner

*Primary Examiner* — Minh Phan
(74) *Attorney, Agent, or Firm* — Canon USA, Inc. IP Division

(57) ABSTRACT

Test patches are formed such that lengths of the test patches in a rotational direction of the intermediate transfer member are shorter than a length of the intermediate transfer member from a primary transfer portion located in the lowermost stream among the plurality of primary transfer portions to the secondary transfer portion.

18 Claims, 9 Drawing Sheets

IMAGE FORMING APPARATUS

BACKGROUND OF THE INVENTION

1. Field of the Invention

The present invention relates to an electrophotographic image forming apparatus, such as a laser printer, a copier and a facsimile.

2. Description of the Related Art

As an electrophotographic image forming apparatus, an image forming apparatus of an intermediate transfer system in which an image is formed using an intermediate transfer belt as an intermediate transfer member has been proposed. In the intermediate transfer system, as a primary transfer step, a toner image formed on a photoconductive drum as an image bearing member is transferred to an intermediate transfer belt. The primary transfer step is repeated for the toner image in each image forming station of yellow (Y), magenta (M), cyan (C), and black (Bk); thus a toner image in which multiple colors are overlapped is formed on the intermediate transfer belt. Then, as a secondary transfer step, the toner image of multiple colors formed on the intermediate transfer belt is transferred on a paper sheet as a recording material. The recording material to which the toner image has been transferred in the secondary transfer is subjected to fixing by a fixing device, whereby image formation is completed.

In such an image forming apparatus, a primary transfer current for performing primary transfer and a secondary transfer current for performing secondary transfer are supplied from a common power supply for the purpose of reducing the cost of the power supply or reducing the size of the image forming apparatus. For example, Japanese Patent Laid-Open No. 2012-137733 discloses a method for performing primary transfer and secondary transfer by applying a current from a secondary transfer portion to an intermediate transfer belt in a circumferential direction thereof with a tension roller of the intermediate transfer belt being grounded via a Zener diode or a varistor.

However, in the method for performing primary transfer and secondary transfer by applying, from a common power supply, a current from the secondary transfer portion to the intermediate transfer belt in the circumferential direction thereof, a primary transfer portion and the secondary transfer portion have the same voltage polarity. Therefore, in a calibration operation in which a test toner image is to be formed on the intermediate transfer belt for detecting color density and registration, a toner image which has already been transferred in the primary transfer to the intermediate transfer belt may arrive at the secondary transfer portion while the toner image to be formed is being transferred in the primary transfer. In this case, since a voltage of reverse polarity with that of the toner is applied to a secondary transfer member in the same manner as in the primary transfer portion, the voltage is applied also to the toner which is not intended to be transferred in the secondary transfer from the intermediate transfer belt; therefore, the toner adheres to the secondary transfer member. If the secondary transfer member is soiled with the toner, electric resistance of the secondary transfer member may become high and thus a desired current supply become difficult to obtain. As a result, insufficient transfer may occur. Further, if the toner adheres to the intermediate transfer belt or to a back surface of the recording material, a defective image may be produced.

SUMMARY OF THE INVENTION

In view of the aforementioned circumstances, the invention related to the present application avoids soiling of a secondary transfer member with toner provided on an intermediate transfer belt in a configuration in which a primary transfer current for performing primary transfer and a secondary transfer current for performing secondary transfer are supplied from a common power supply.

The present invention provides an image forming apparatus which includes: a plurality of image bearing members on which electrostatic latent images are formed; a plurality of developing units configured to develop each of the electrostatic latent images formed on the image bearing members as a toner image; an intermediate transfer medium; a primary transfer unit configured to transfer, as primary transfer, the plurality of toner images developed by the developing units to the intermediate transfer member in a plurality of primary transfer portions; a secondary transfer unit configured to transfer, as secondary transfer, the toner images which have been transferred as the primary transfer to the intermediate transfer member to a recording material in a secondary transfer portion; a supply unit configured to supply a common transfer current to the primary transfer unit and the secondary transfer unit used for the transfer; a forming unit configured to form a test patch for correcting color misregistration or color density; and a detecting unit configured to detect the test patch formed on the intermediate transfer member, wherein a length of the test patch in a rotational direction of the intermediate transfer member is shorter than a length of the intermediate transfer member from a primary transfer portion located in the lowermost stream among the plurality of primary transfer portions to the secondary transfer portion.

Further features of the present invention will become apparent from the following description of exemplary embodiments with reference to the attached drawings.

DESCRIPTION OF THE EMBODIMENTS

Hereinafter, embodiments of the present invention will be described with reference to the drawings. It should be noted that the following embodiments do not limit the present invention related to the claims and not all the combinations of features described in the embodiments are necessary for the means for solving the problems.

First Embodiment

Description of Image Forming Apparatus

Figure 1:
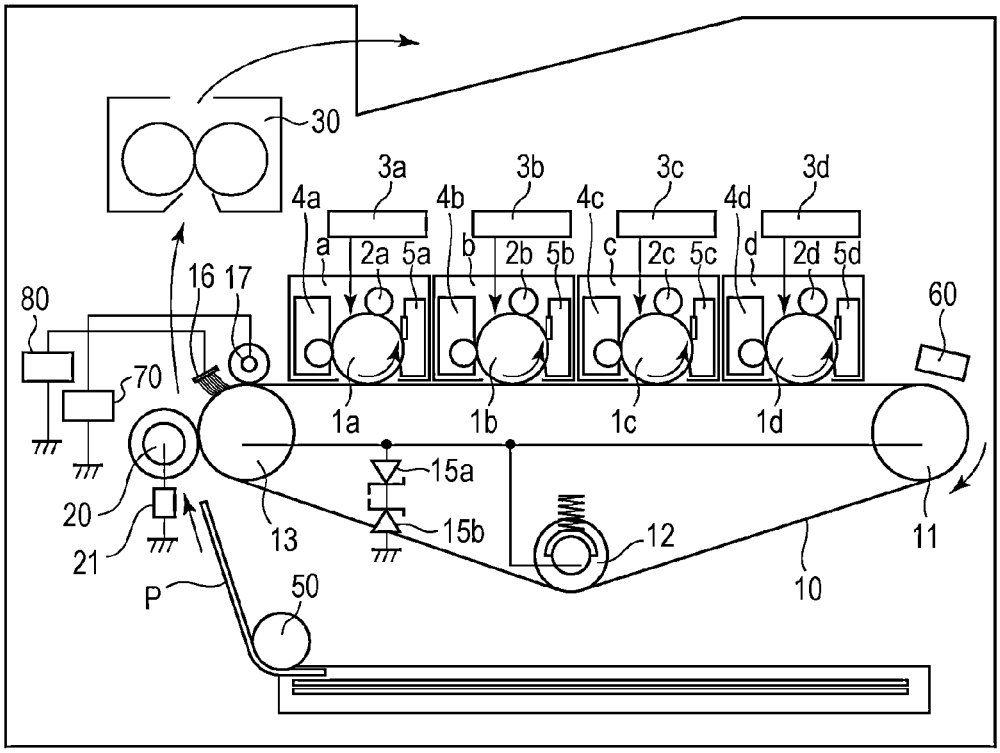
FIG. 1 is a schematic configuration diagram of a color image forming apparatus.

FIG. 1 is a schematic configuration diagram of a color image forming apparatus. The image forming apparatus according to the present embodiment is constituted by first to fourth image forming stations (a to d): the first station is an yellow image forming station; the second station is a magenta image forming station; the third station is a cyan image forming station; and the fourth station is a black image forming station. The image forming apparatus is a four-tandem-drum mechanism (in-line system) printer which includes a plurality of photoconductive drums 1 (1*a*, 1*b*, 1*c* and 1*d*) as first image bearing members; while being driven to rotate in directions indicated by arrows, the photoconductive drums 1 sequentially perform primary transfer to an intermediate transfer belt 10 as a second image bearing member, whereby a full color image is obtained.

For the convenience of description, an image formation operation in the first station (a) will be described hereinafter. Other stations (b to d) have the same configurations as that of the first station (a). The photoconductive drum 1*a* is charged uniformly at a predetermined potential by a charging roller 2*a*. The photoconductive drum 1*a* is then illuminated with a laser beam emitted by an exposure device 3*a*. Therefore, an electrostatic latent image corresponding to a yellow color of a color image is formed. Then the electrostatic latent image is developed by a first developing unit (i.e., a yellow developing unit) 4*a* at a developing position and is visualized as a yellow toner image.

The yellow toner image formed on the photoconductive drum 1*a* is transferred to the intermediate transfer belt 10 (i.e., to an intermediate transfer member) in a process in which the yellow toner image passes a primary transfer portion (hereafter, referred also to as a primary transfer nip) which is a contact portion between the photoconductive drum 1*a* and the intermediate transfer belt 10 (a primary transfer step). A power feeding device for the primary transfer will be described later. Primary-transfer-residual toner remaining on a surface of the photoconductive drum 1*a* is cleaned by a cleaning device 5*a*. If the printing is to be continued, the process returns to the charging step and repeats the image formation process thereafter. Then, similarly, a magenta toner image as a second color, a cyan toner image as a third color and a black toner image as a fourth color are formed and are transferred sequentially to the intermediate transfer belt 10 in an overlapped manner. In this manner, a color toner image is obtained.

In a process in which the color toner image of four colors on the intermediate transfer belt 10 passes a secondary transfer portion (hereafter, referred also to as a secondary transfer nip) which is a contact portion between the intermediate transfer belt 10 and a secondary transfer roller 20, the color toner image of four colors on the intermediate transfer belt 10 is transferred collectively to a surface of a recording material P which has been fed by a sheet feeding device 50 due to a secondary transfer voltage applied to the secondary transfer roller 20 by a secondary transfer high-voltage power supply 21 (a secondary transfer step). Then, the recording material P which bears the toner image of four colors thereon is conveyed to a fusing unit 30, where the recording material P is heated and pressed so that the toner of four colors are fused and mixed and then fixed to the recording material P. With the above-described operation, a full color image is formed.

The intermediate transfer belt 10 is stretched over a driving roller 11, a tension roller 12 and a secondary transfer facing roller 13, and is driven to rotate at substantially the same peripheral speed as that of the photoconductive drums 1. The secondary transfer roller 20 is connected to the secondary transfer high-voltage power supply 21 so that voltages of positive and negative polarities are applied to the secondary transfer roller 20 from the secondary transfer high-voltage power supply 21. A conductive brush 16 is made of electrically-conductive fiber. The conductive brush 16 is connected to a conductive brush high-voltage power supply 80 so that voltages of positive and negative polarities are applied to the conductive brush 16 from the conductive brush high-voltage power supply 80.

Next, a method for supplying a primary transfer current will be described. A potential of the intermediate transfer belt 10 is formed by applying a current in a circumferential direction of the intermediate transfer belt 10 using the secondary transfer high-voltage power supply 21 as a current supply device. The primary transfer is performed when toner of negative polarity on the photoconductive drums 1 is moved to the intermediate transfer belt 10 due to a potential difference between the intermediate transfer belt 10 and the photoconductive drums 1 (1*a*, 1*b*, 1*c* and 1*d*). In order to stabilize the potential of the intermediate transfer belt 10, the driving roller 11, the tension roller 12 and the secondary transfer facing roller 13 over which the intermediate transfer belt 10 is stretched are grounded via two Zener diodes 15*a* and 15*b* which are connected in series and in opposite directions.

If a positive current is applied to the intermediate transfer belt 10 in the circumferential direction thereof, the positive currents applied to the driving roller 11, the tension roller 12 and the secondary transfer facing roller 13 become constant due to the effect of the Zener diode 15*a*. Then, the driving roller 11, the tension roller 12 and the secondary transfer facing roller 13 stably form the potential of +300V. Therefore, since the current is applied along the circumferential direction of the intermediate transfer belt 10 from each of the driving roller 11, the tension roller 12 and the secondary transfer facing roller 13, the potential of the intermediate transfer belt 10 in the primary transfer portion is also set to be about +300V.

On the contrary, if a negative current is applied to the intermediate transfer belt 10 in the circumferential direction thereof, the negative currents applied to the driving roller 11, the tension roller 12 and the secondary transfer facing roller 13 become constant due to the effect of the Zener diode 15*b*. Then, the driving roller 11, the tension roller 12 and the secondary transfer facing roller 13 stably form the potential of −300V. Therefore, since the current is applied along the circumferential direction of the intermediate transfer belt 10 from each of the driving roller 11, the tension roller 12 and the secondary transfer facing roller 13, the potential of the intermediate transfer belt 10 in the primary transfer portion is also set to be about −300V.

Next, cleaning of secondary-transfer-residual toner will be described. After the completion of the secondary transfer, the secondary-transfer-residual toner of toner of positive polarity and toner of negative polarity exist together on the intermediate transfer belt 10. The secondary-transfer-residual toner is uniformly scattered and charged by the conductive brush 16. A positive polarity voltage is applied to the conductive brush 16 by the conductive brush high-voltage power supply 80 so that the secondary-transfer-residual toner is charged positively. A positive polarity voltage is applied to a conductive roller 17 by a conductive roller high-voltage power supply 70 so that the secondary-transfer-residual toner, which has passed the conductive brush 16 and has been charged positively, is further charged positively. In the primary transfer portion, the positively-charged secondary-transfer-residual toner is transferred to the photoconductive drums 1 and is collected by cleaning devices 5 disposed at the photoconductive drums 1.

Description of Control Block Diagram

Figure 2:
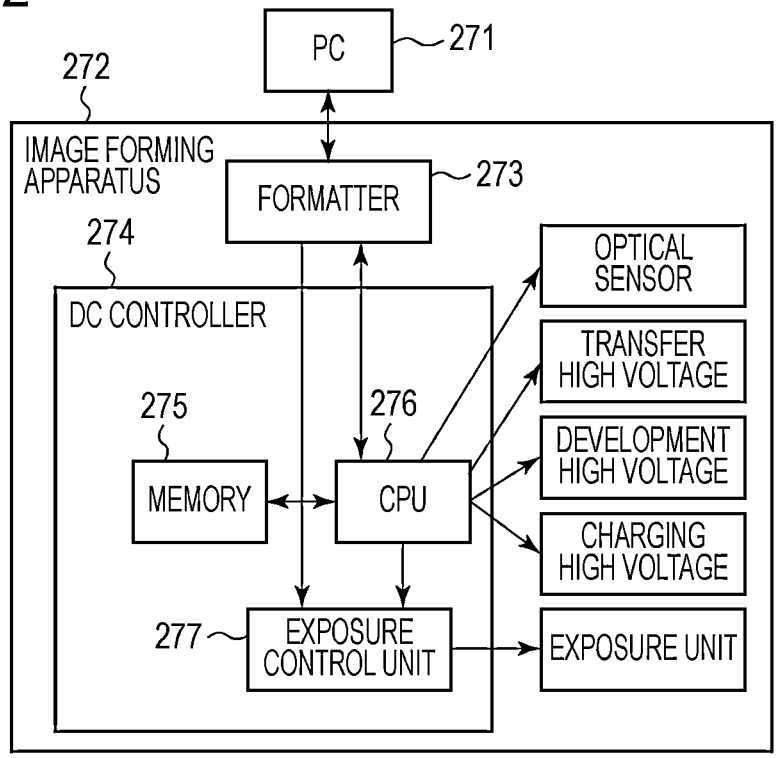
FIG. 2 is a control block diagram illustrating control of an operation of the image forming apparatus.

FIG. 2 is a control block diagram illustrating control of an operation of the image forming apparatus. A PC 271 which is a host computer issues a print command to a formatter 273 located inside an image forming apparatus 272, and transmits image data of the print image to the formatter 273. The formatter 273 converts the image data received from the PC 271 into exposure data and transfers the converted data to an exposure control unit 277 located inside a DC controller 274. The exposure control unit 277 controls an exposure device in accordance with an instruction from a CPU 276 by controlling on and off of the exposure data. Upon reception of the print command from the formatter 273, the CPU 276 starts an image formation sequence. The CPU 276, memory 275 and the like are mounted on the DC controller 274 and the DC controller 274 performs operations programmed in advance. The CPU 276 performs image formation by controlling, for example, formation of electrostatic latent images and transfer of developed toner images with the control of a charging high voltage, development high voltage and transfer high voltage.

The CPU 276 also performs a process to receive a signal from an optical sensor 60 during calibration. During calibration, test patches are formed on the intermediate transfer belt 10 and an amount of reflected light from the test patches is measured. An optical signal from the test patches received by a light-receiving element 63 is A/D converted via the CPU 276 and then stored in the memory 275. The optical sensor 60 does not operate in normal printing sequences but operates at calibration operations, such as registration control and color density control.

Description of Optical Sensor

Next, the optical sensor 60 will be described. The optical sensor 60 is provided to detect test patches formed on the intermediate transfer belt 10. The test patches are moved in a rotational direction of the intermediate transfer belt 10 and, while passing an irradiation area of the optical sensor 60, diffuse and reflect the infrared light emitted by a light-emitting element 61. The optical sensor 60 detects position and color density of each of the test patches of each color by detecting diffuse reflected light by a light-receiving element 62.

Figure 3:
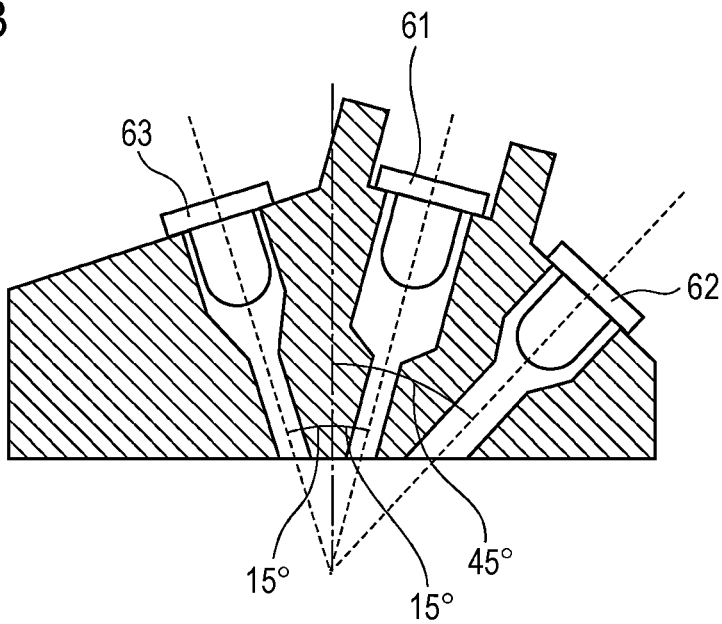
FIG. 3 is a cross-sectional view of an optical sensor.

FIG. 3 is a cross-sectional view of the optical sensor 60. The optical sensor 60 includes the light-emitting element 61, such as an LED, light-receiving elements 62 and 63, such as phototransistors, and a holder. The light-emitting element 61 is disposed at an angle of 15 degrees with the intermediate transfer belt 10 and illuminates the test patches on the intermediate transfer belt 10 and a surface of the intermediate transfer belt 10 with infrared light (having wavelength of, for example, 950 nm). The light-receiving element 62 is disposed at an angle of 45 degrees with the intermediate transfer belt 10 and receives the infrared light diffused and reflected from the test patches or the surface of the intermediate transfer belt 10. The light-receiving element 63 is disposed at an angle of 15 degrees with the intermediate transfer belt 10 and receives the infrared light normally reflected from the test patches or the surface of the intermediate transfer belt 10. The optical sensor 60 is used to detect the test patches formed during calibration. Specifically, the test patches may include a pattern for color misregistration control for detecting an overlapping error of color images, and a pattern for correcting color density for controlling color density of an image.

Method for Forming Test Patches

Figure 4:
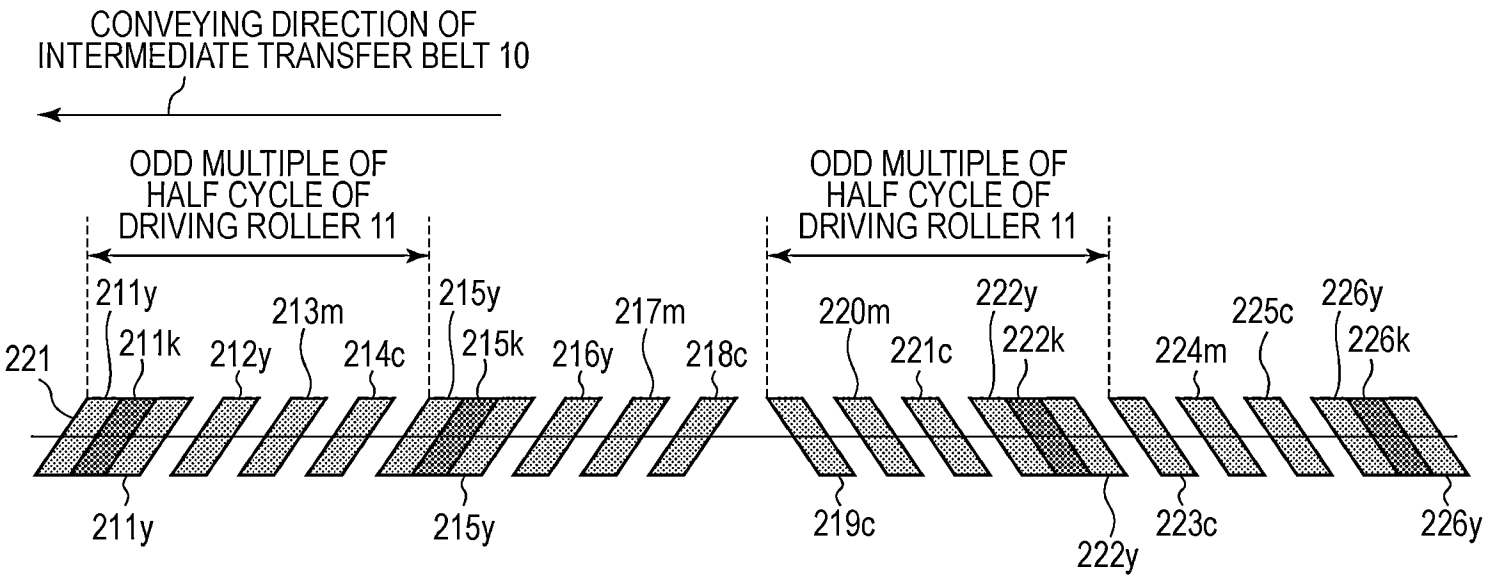
FIG. 4 is a diagram illustrating a pattern for color misregistration control as a test patch.
Figure 5:
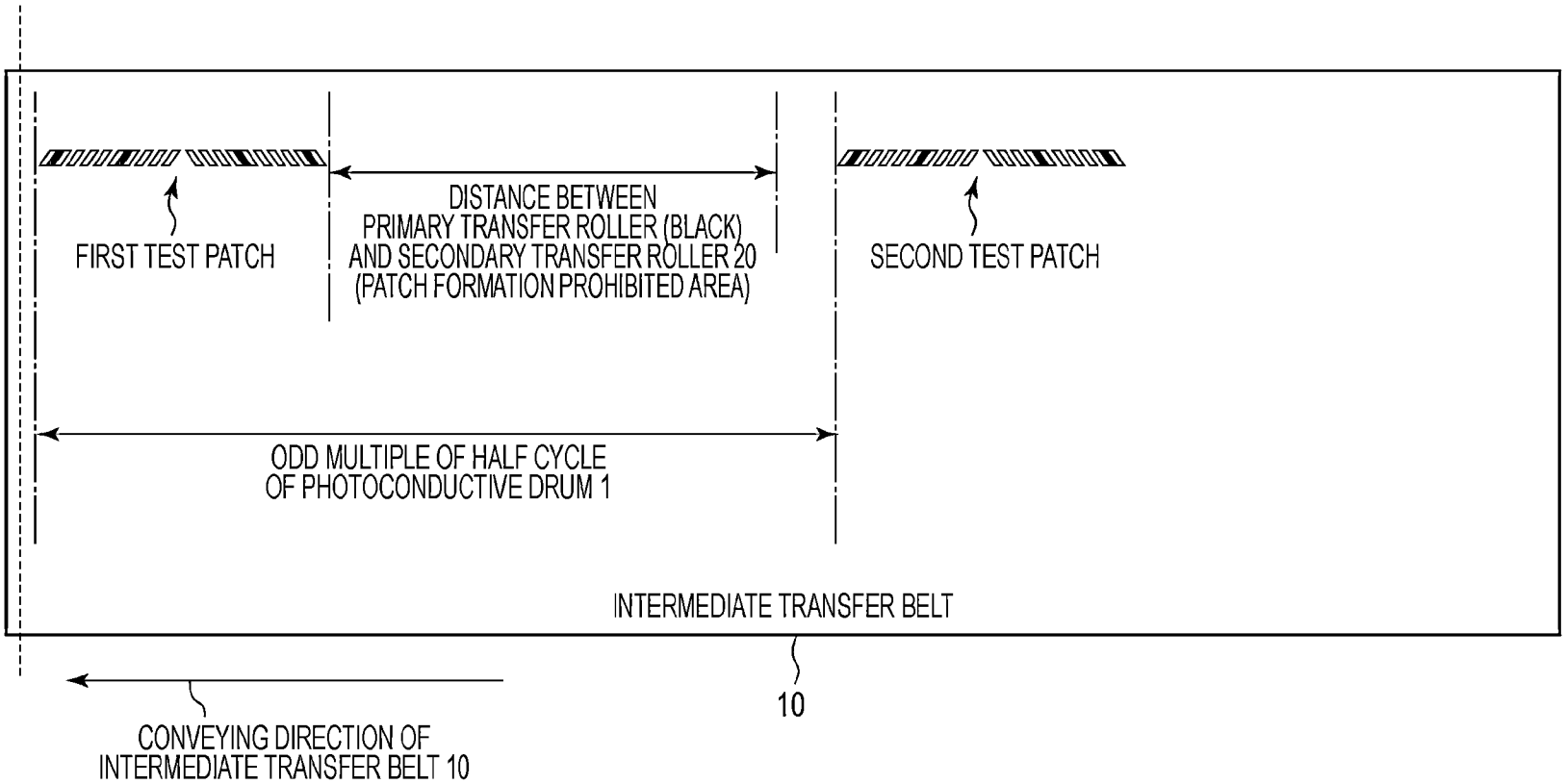
FIG. 5 is diagram illustrating positional relationships in a state in which test patches are disposed on an intermediate transfer belt.

FIG. 4 is a diagram illustrating a pattern for color misregistration control 221 as a test patch. FIG. 5 is a diagram illustrating positional relationships in a state in which the test patches are disposed on the intermediate transfer belt 10. In the pattern for color misregistration control as the test patch, each patch is formed in a parallelogram shape; parallelogram-shaped patches 211*y* to 218*c* and parallelogram-shaped patches 219*c* to 226*y* are formed to be oriented in opposite directions. In each of the patches 211*y* to 218*c* and the patches 219*c* to 226*y*, two parallelogram-shaped patches of the same color are formed to be oriented in the same direction.

Next, nonuniformity in a rotational cycle of each rotary member which affects detection of the test patches will be described. Eccentricity of the photoconductive drums 1 may be caused due to, for example, production tolerance. If eccentricity has occurred in the photoconductive drums 1, nonuniformity is caused in the rotational cycle of the photoconductive drums 1. In that case, nonuniformity is caused in the timing at which the test patches are detected by the optical sensor 60. Another cause of nonuniformity in the rotational cycle is existence of the driving roller 11. The intermediate transfer belt 10 is rotated by the driving roller 11 which is driven to rotate; the driving roller 11 is also subjected to eccentricity caused due to, for example, production tolerance. If eccentricity has occurred in the driving roller 11, variation is caused in the rotational speed of the intermediate transfer belt 10. In that case, unevenness is caused in the timing at which the test patches are detected by the optical sensor 60. Therefore, in order to perform more precise color misregistration correction, it is necessary to eliminate the nonuniformity in the rotational cycle of the photoconductive drums 1 and the driving roller 11.

In the test patch illustrated in FIG. 4, an interval between the patches of the same color is set to be an odd multiple of a half cycle of the rotational cycle of the driving roller 11 in order to eliminate the nonuniformity in the rotational cycle of the driving roller 11. For example, 211*y* and 215*y*, 213*m* and 217*m*, and 214*c* and 218*c* are disposed at intervals of 0.5 times half the rotational cycle of the driving roller 11, and 219*c* and 223*c*, 220*m* and 224*m*, and 222*y* and 226*y* are also disposed at intervals of 0.5 times half the rotational cycle of the driving roller 11. By setting the patch intervals to be the odd multiple of a half cycle of the rotational cycle of the driving roller 11, the patches which are oppositely affected by the eccentricity are detected; therefore, by averaging timing of detection of two patches, an influence of the nonuniformity in the rotational cycle may be eliminated. Similarly, elimination of the nonuniformity in the rotational cycle of the photoconductive drums 1 can be considered as that of the driving roller 11. As illustrated in FIG. 5, a distance between a front end of the first test patch and a front end of the second test patch is set to be an odd multiple of a half cycle of the photoconductive drum 1 in order to eliminate the nonuniformity in the rotational cycle of the photoconductive drum 1.

Next, the intervals at which the test patches are formed on the intermediate transfer belt 10 will be described with reference to FIG. 5. Here, the test patches are constituted by the first test patch and the second test patch as an example. In the present embodiment, the primary transfer current for performing primary transfer and a secondary transfer current for performing secondary transfer are supplied from a common power supply. Therefore, if the test patches pass the secondary transfer portion in a state in which the primary transfer of the test patches is being performed, toner is transferred to the secondary transfer roller and thus the secondary transfer roller is soiled. Then, in order to form the test patches so that the toner is not transferred to the secondary transfer roller, it is desirable that lengths of the first test patch and the second test patch are set to be at least shorter than a distance between a primary transfer position (black) on the lowermost stream in a rotational direction of the intermediate transfer belt 10 and the secondary transfer roller 20 with respect to the rotational direction of the intermediate transfer belt 10. Further, it is desirable that an interval between a rear end of the first test patch and the front end of the second test patch is set to be at least longer than the distance between the primary transfer position (black) and the secondary transfer roller 20 with respect to the rotational direction of the intermediate transfer belt 10. The interval between the rear end of the first test patch and the front end of the second test patch is referred also to as a patch formation prohibited area. With this configuration, the primary transfer is not being performed when the first test patch and the second test patch are passing the secondary transfer portion; and thus adhesion of toner of the first test patch and the second test patch to the secondary transfer roller 20 may be avoided by application of a negative polarity voltage to the secondary transfer roller 20.

Timing Chart of Formation of Test Patches

Figure 6:
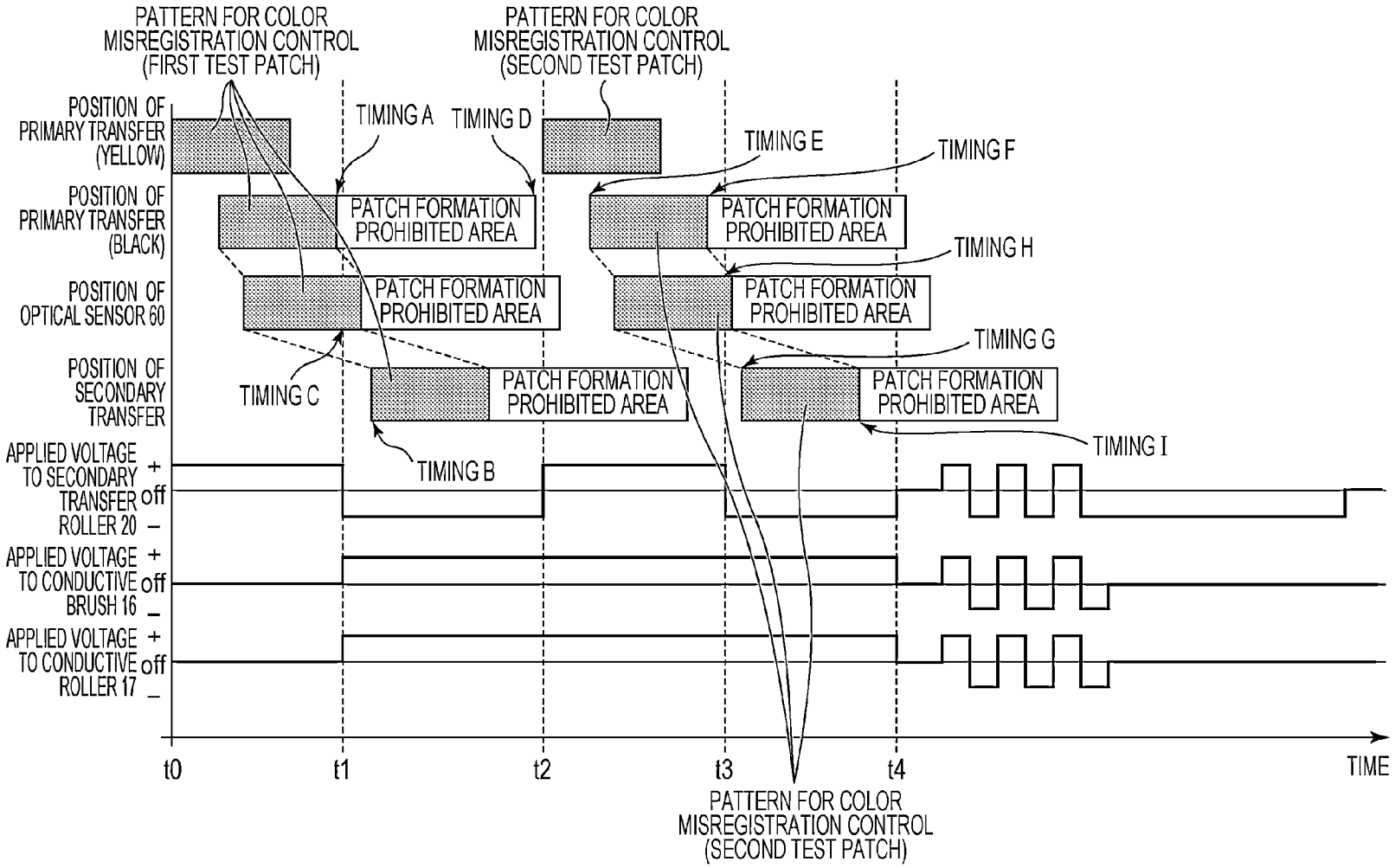
FIG. 6 is a timing chart illustrating a flow in which the test patches are formed.

FIG. 6 is a timing chart illustrating a flow in which the test patches are formed. This timing chart illustrates timings at which the first test patch, the patch formation prohibited area and the second test patch pass a primary transfer position (yellow), the primary transfer position (black), a detecting position facing the optical sensor 60, and the secondary transfer position. The timing chart also illustrates timings at which voltages are applied to the secondary transfer roller 20, the conductive brush 16 and the conductive roller 17.

t0 is a timing at which primary transfer of the first test patch is started. Before the front end of the first test patch formed on the photoconductive drum 1 arrives at the primary transfer position, application of a positive voltage to the secondary transfer roller 20 is completed; therefore, primary transfer of the first test patch from the photoconductive drums 1*a* to 1*d* to the intermediate transfer belt 10 is performed. Here, a voltage to be applied to the conductive brush 16 and the conductive roller 17 is off; however, if resistance of the secondary transfer roller 20 is high due to deterioration or usage in a low-temperature and low-humidity environment and thus a sufficient amount of current is not able to be supplied in the circumferential direction of the intermediate transfer belt 10, a current to be applied to the photoconductive drums 1 from the intermediate transfer belt 10 may be increased to assist the primary transfer by applying the positive voltage to the conductive brush 16, the conductive roller 17 or both of them.

The first test patch which has been transferred in the primary transfer passes the detecting position of the optical sensor 60 from timing t0 to t2. At this time, infrared light received from the light-emitting element 61 is diffused and reflected by the first test patch and the diffuse reflected light is received by the light-receiving element 62; thus passage timing of the first test patch is detected.

Next, t1 is a timing after the rear end of the first test patch passes the primary transfer position (black) (timing A) and, at the same time, before the front end of the first test patch arrives at the secondary transfer portion (timing B). That is, a length of the first test patch is set to be at least shorter than a distance between the primary transfer position (black) and the secondary transfer roller 20 with respect to the rotational direction of the intermediate transfer belt 10. At timing t1, the polarity of the voltage to be applied to the secondary transfer roller 20 is switched from positive to negative. Since the polarity of the toner of the first test patch is mainly negative, by switching the polarity of the voltage to be applied to the secondary transfer roller 20 to negative before the front end of the first test patch arrives at the secondary transfer roller 20, it is possible to avoid adhesion of the toner of the first test patch to the secondary transfer roller 20. Here, switching of the polarity of the voltage to be applied to the secondary transfer roller 20 to negative is completed before the front end of the first test patch arrives at the secondary transfer portion, i.e., by timing B. Ideally, switching of the polarity of the voltage to negative is desirably completed by timing B; however, timing of completion of switching is not limited to the same. That is, even if the polarity of the voltage applied to the secondary transfer roller 20 has not been switched to negative completely, as long as the polarity of the voltage is switched to negative, the direction of the electrostatic force acting on the toner of the first test patch is oriented toward the intermediate transfer belt 10 instead of the secondary transfer roller 20. Therefore, even if the negative polarity voltage has not reached a desired voltage, a toner amount adhering to the secondary transfer roller 20 decreases significantly. Therefore, it is only necessary that the negative polarity voltage is applied to the secondary transfer roller 20 before the front end of the first test patch arrives at the secondary transfer roller 20.

Similarly, the positive voltage is applied to the conductive brush 16 and the conductive roller 17 at the same timing t1. By applying the positive polarity voltage to the conductive brush 16 and the conductive roller 17, the first test patch is collected by the conductive brush and the conductive roller 17. After a calibration operation is completed, the collected first test patch is sent out on the intermediate transfer belt 10 through the conductive brush 16 and the conductive roller 17 and is retransferred to the photoconductive drums 1 from the intermediate transfer belt 10. Then cleaning is performed by the cleaning devices on the photoconductive drums 1. In FIG. 6, the polarity of the voltage to be applied to the secondary transfer roller 20 is switched from positive to negative when the first test patch is being detected by the optical sensor 60 (timing C). However, if the polarity of the voltage to be applied is switched during detection by the optical sensor 60, electrostatic adsorptive power acting between the secondary transfer roller 20 and the intermediate transfer belt 10 may be varied; therefore, the rotational speed of the intermediate transfer belt 10 may be changed. The change in the rotational speed of the intermediate transfer belt 10 may cause a detection timing shift of the first test patch and then cause an error. Therefore, it is also possible that, if the polarity of the voltage to be applied to the secondary transfer roller 20 is switched after the rear end of the first test patch passes a detection area of the optical sensor 60, a more stable detection result may be obtained.

Next, t2 is a timing after the rear end of the patch formation prohibited area passes the primary transfer position (black) (timing D) and, at the same time, before the primary transfer of the second test patch is started (timing E). That is, a length of the patch formation prohibited area is set to be at least longer than a distance between the primary transfer position (black) and the secondary transfer roller 20 with respect to the rotational direction of the intermediate transfer belt 10. At timing t2, the polarity of the voltage to be applied to the secondary transfer roller 20 is switched from negative to positive and the primary transfer of the second test patch is performed. Therefore, since the primary transfer of the second test patch may be started after the rear end of the preceding first test patch passes the secondary transfer portion, it is possible to avoid adhesion of the toner of the first test patch to the secondary transfer roller 20. Here, switching of the polarity of the voltage to be applied to the secondary transfer roller 20 to positive is completed after the rear end of the first test patch passes the secondary transfer portion, i.e., at timing E. By continuously applying the positive voltage to the conductive brush 16 and the conductive roller 17, the toner collected by the conductive brush 16 and the conductive roller 17 is avoided from moving toward the intermediate transfer belt 10.

Next, t3 is a timing after a rear end of the second test patch passes the primary transfer position (black) (timing F) and, at the same time, before the front end of the second test patch arrives at the secondary transfer roller 20 (timing G). That is, a length of the second test patch is set to be at least shorter than a distance between the primary transfer position (black) and the secondary transfer roller 20 with respect to the rotational direction of the intermediate transfer belt 10. At timing t3, the polarity of the voltage to be applied to the secondary transfer roller 20 is switched from positive to negative. Since the polarity of the toner of the second test patch is negative, by switching the polarity of the voltage to be applied to the secondary transfer roller 20 to negative before the front end of the second test patch arrives at the secondary transfer roller 20, it is possible to avoid adhesion of the toner of the second test patch to the secondary transfer roller 20.

Similarly, the positive voltage is applied to the conductive brush 16 and the conductive roller 17 at the same timing t3. By applying the positive polarity voltage to the conductive brush 16 and the conductive roller 17, the second test patch is collected by the conductive brush and the conductive roller 17. After a calibration operation is completed, the collected second test patch is sent out on the intermediate transfer belt 10 through the conductive brush 16 and the conductive roller 17 and is retransferred to the photoconductive drums 1 from the intermediate transfer belt 10. Then cleaning is performed by the cleaning devices on the photoconductive drums 1. In FIG. 6, the polarity of the voltage to be applied to the secondary transfer roller 20 is switched from positive to negative when the second test patch is being detected by the optical sensor 60 (timing H). However, if the polarity of the voltage to be applied is switched during detection by the optical sensor 60, electrostatic adsorptive power acting between the secondary transfer roller 20 and the intermediate transfer belt 10 may be varied; therefore, the rotational speed of the intermediate transfer belt 10 may be changed. The change in the rotational speed of the intermediate transfer belt 10 may cause a detection timing shift of the second test patch and then cause an error. Therefore, it is also possible that, if the polarity of the voltage to be applied to the secondary transfer roller 20 is switched after the rear end of the second test patch passes a detection area of the optical sensor 60, a more stable detection result may be obtained.

Next, t4 is a timing after the rear end of the second test patch passes the secondary transfer roller 20 (timing I). The voltage being applied to the secondary transfer roller 20, the conductive brush 16 and the conductive roller 17 are turned off, whereby the calibration operation for color misregistration correction control is completed. Since the toner collected by the conductive brush 16 and the conductive roller 17 is mainly the toner of negative polarity, the toner is sent out on the intermediate transfer belt 10 when, after the calibration operation, the negative and positive voltages are applied to the conductive brush 16 and the conductive roller 17 alternately. Before the timing at which the toner sent out on the intermediate transfer belt 10 arrives at the primary transfer position, the negative polarity voltage being applied to the charging rollers 2 is turned off and the photoconductive drums 1 are uniformly exposed by the exposure devices 3. A surface potential of the photoconductive drums 1 which have been exposed uniformly is about −100V. Since a negative polarity voltage has been applied to the conductive brush 16, the conductive roller 17 or the secondary transfer roller 20, the potential of the intermediate transfer belt 10 in the primary transfer position is set to be about −300V. Therefore, the toner sent out on the intermediate transfer belt 10 is retransferred to the photoconductive drums 1 from the intermediate transfer belt 10 by electrostatic force, and the toner retransferred to the photoconductive drums 1 is cleaned by the cleaning devices on the photoconductive drums 1.

In this manner, lengths of the first test patch and the second test patch are set to be at least shorter than the distance between the primary transfer position (black) and the secondary transfer roller 20 with respect to the rotational direction of the intermediate transfer belt 10. Further, an interval between the rear end of the first test patch and the front end of the second test patch is set to be at least longer than the distance between the primary transfer position (black) and the secondary transfer roller 20 with respect to the rotational direction of the intermediate transfer belt 10. Therefore, the negative polarity voltage may be applied to the secondary transfer roller 20 while the test patches pass the secondary transfer roller 20; thus, soiling of the secondary transfer roller 20 due to secondary transfer of the test patches to the secondary transfer roller 20 may be avoided.

In the present embodiment, the number of test patches is two; however, even in a case in which three or more test patches are formed, soiling of the secondary transfer roller 20 by those test patches may be avoided by providing patch formation prohibited areas between adjoining test patches. In the present embodiment, the test patches are described as patterns for color misregistration control; however, the test patches are not limited to the same. For example, in patterns for density control, the same effect may be provided by forming test patches under the same conditions as described above.

Figure 7:
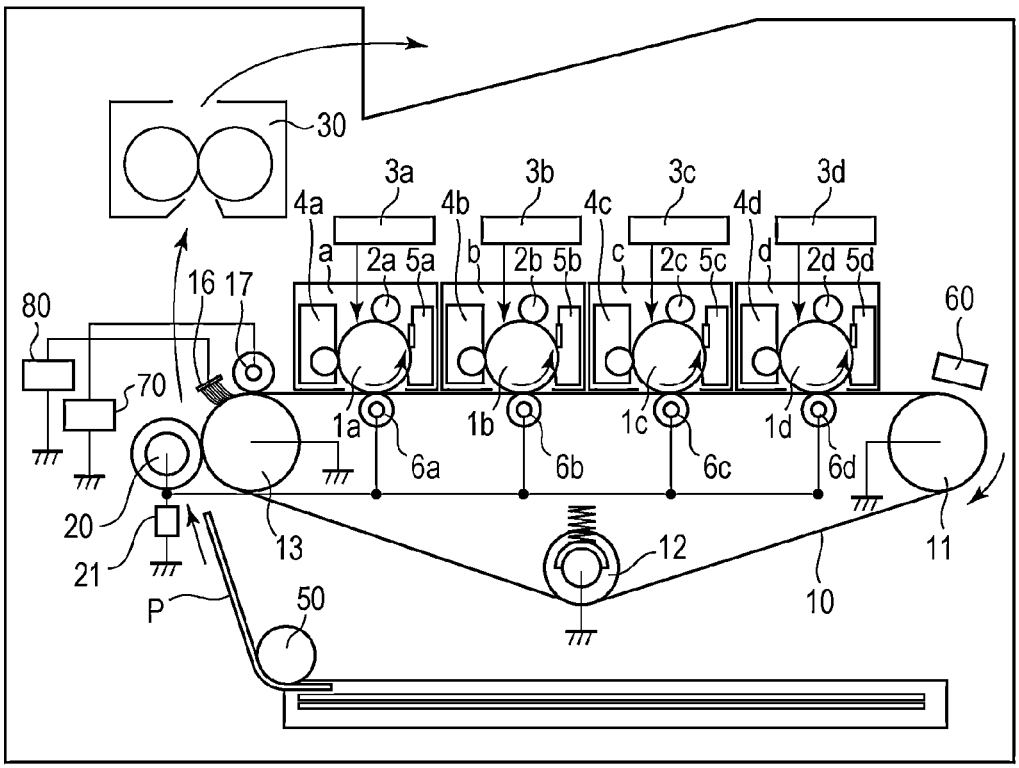
FIG. 7 is a schematic configuration diagram of a color image forming apparatus.

In the image forming apparatus according to the present embodiment, the primary transfer is performed by charging the intermediate transfer belt 10 through application of the current in the circumferential direction of the intermediate transfer belt 10 using the secondary transfer high-voltage power supply 21. However, the configuration of the image forming apparatus is not limited to the same. For example, an image forming apparatus which includes a secondary transfer roller 20 and primary transfer rollers 6*a* to 6*d* as primary transfer members as illustrated in FIG. 7 may also provide the same effect; in this apparatus, a common high-voltage power supply is used to apply a voltage to the secondary transfer roller 20 and the primary transfer rollers 6*a* to 6*d*. In the foregoing, the method for collecting the toner which remains on the intermediate transfer belt 10 by the conductive brush 16 and the conductive roller 17 and then collecting by the cleaning devices on the photoconductive drums 1 has been described; however, cleaning may be performed by a cleaning device provided on the intermediate transfer belt 10.

Second Embodiment

In the present embodiment, a method for forming a second test patch so as not to overlap a portion in which a first test patch has been formed will be described; in this method, the first test patch is cleaned after being formed. That is, a distance between a rear end of the first test patch and a front end of the second test patch is set to be equal to or greater than the sum of a length of the entire circumference of an intermediate transfer belt 10 and the length of the first test patch.

Timing Chart of Formation of Test Patches

Figure 8:
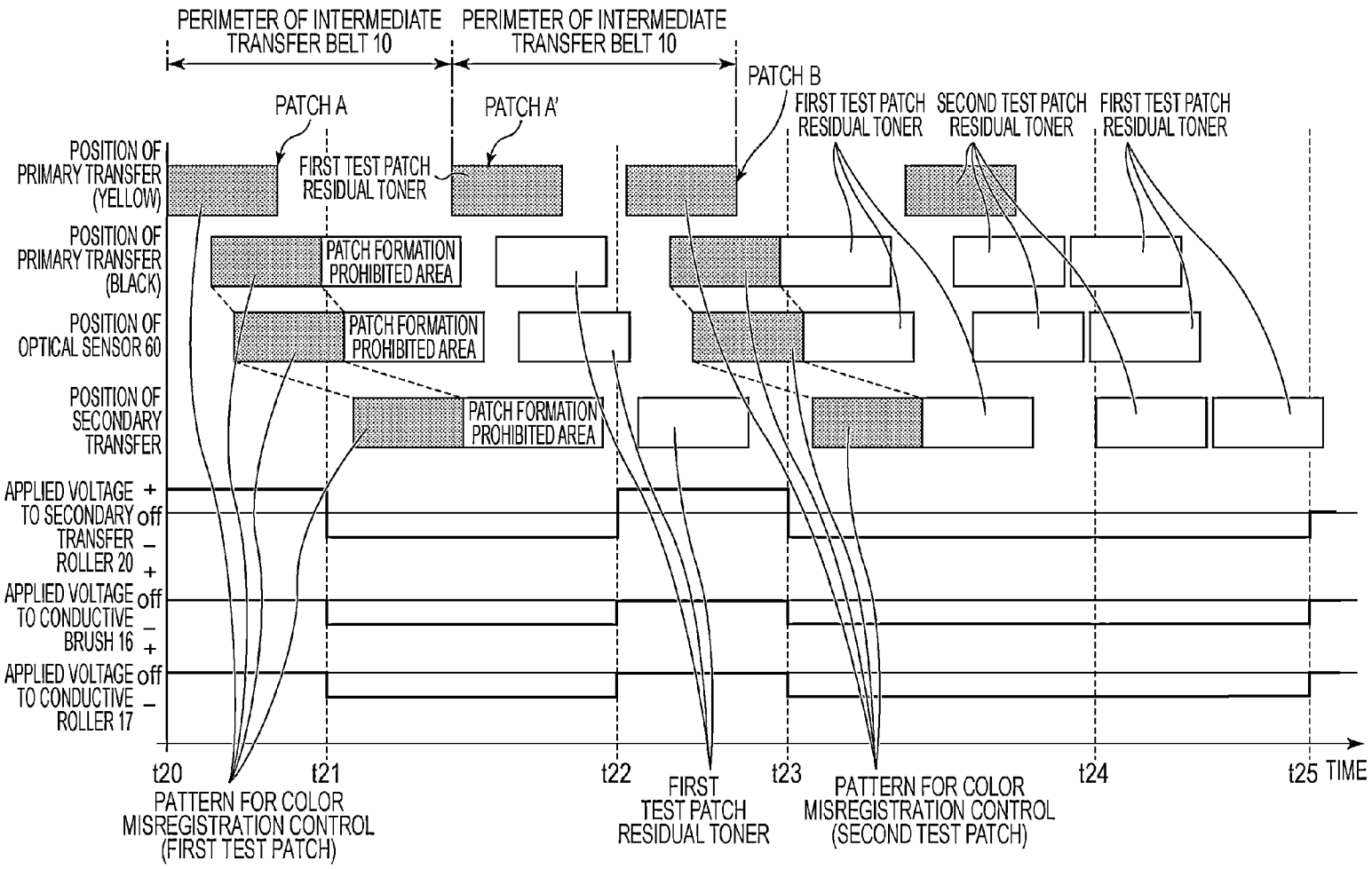
FIG. 8 is a timing chart illustrating a flow in which test patches are formed.

FIG. 8 is a timing chart illustrating a flow in which the test patches are formed. This timing chart illustrates timings at which the first test patch, residual toner of the first test patch, the patch formation prohibited area and the second test patch pass a primary transfer position (yellow), the primary transfer position (black), a detecting position facing the optical sensor 60, and the secondary transfer position. The timing chart also illustrates timings at which voltages are applied to the secondary transfer roller 20, the conductive brush 16 and the conductive roller 17. Hereinafter, an operation at each timing will be described. Description of the same operations as those described in foregoing FIG. 6 related to the first embodiment will be omitted.

t21 is a timing at which a rear end of the first test patch (hereafter, referred also to as a patch A) passes a primary transfer position (black) and, at the same time, before a front end of the first test patch arrives at the secondary transfer roller 20. That is, a length of the first test patch is set to be at least shorter than a distance between the primary transfer position (black) and the secondary transfer roller 20 with respect to the rotational direction of the intermediate transfer belt 10. By applying a negative polarity voltage to the secondary transfer roller 20, a conductive brush 16 and a conductive roller 17 at timing t21, it is possible to avoid adhesion of toner of the first test patch to the secondary transfer roller 20.

The negative polarity voltage is continuously applied even after the first test patch arrives at a primary transfer position (yellow). A potential of a surface of the intermediate transfer belt 10 is set to be about −300V due to an effect of a Zener diode 15*a* through application of the negative polarity voltage to the secondary transfer roller 20, the conductive brush 16 and the conductive roller 17. Before the timing at which the front end of the first test patch arrives at the primary transfer position (yellow) again, the negative polarity voltage being applied to a charging roller 2*a* is turned off and a photoconductive drum 1*a* is uniformly exposed by an exposure device 3*a*. By uniformly exposing the photoconductive drum 1*a*, a surface potential of the photoconductive drum 1*a* is set to be about −200V. Since a toner polarity of the first test patch is negative, the toner is retransferred to the photoconductive drum 1*a* from the intermediate transfer belt 10 by electrostatic force in a primary transfer portion. Note that the first test patch may be collected not only by the cleaning device on the photoconductive drum 1*a* but also by cleaning devices on the photoconductive drums 1*b*, 1*c* and 1*d* in order to avoid a situation in which an amount of residual toner to be collected in a cleaning device on the photoconductive drum 1*a* is increased and a residual toner vessel is filled with the residual toner.

Next, t22 is a timing after a rear end of the residual toner of the first test patch (hereafter, referred also to as a patch A') passes a primary transfer position (yellow) and, at the same time, a front end of a second test patch (hereafter, referred also as a patch B) is subjected to the primary transfer. At timing t22, the polarity of the voltage to be applied to the secondary transfer roller 20 is switched from negative to positive and the primary transfer of the second test patch is performed. By performing the primary transfer of the second test patch at this timing, the patch A' and the patch B are disposed so as not to overlap each other on the intermediate transfer belt 10. Therefore, the second test patch is formed in an area not corresponding to an area in which the first test patch has been formed and then cleaned; thus, the second test patch may be detected with decreased detection precision due to the residual toner of the first test patch being avoided.

Next, t23 is a timing after a rear end of the second test patch passes the primary transfer position (black) and, at the same time, before the front end of the second test patch arrives at the secondary transfer roller 20. That is, a length of the second test patch is set to be at least shorter than a distance between the primary transfer position (black) and the secondary transfer roller with respect to the rotational direction of the intermediate transfer belt 10. By applying a negative polarity voltage to the secondary transfer roller 20, a conductive brush 16 and a conductive roller 17 at timing t23, it is possible to avoid adhesion of toner of the second test patch to the secondary transfer roller 20.

Next, t24 is a timing after the rear end of the second test patch passes the photoconductive drum 1*a* and, at the same time, residual toner of the first test patch and residual toner of the second test patch exist on the intermediate transfer belt 10. The negative polarity voltage is continuously applied to the secondary transfer roller 20, the conductive brush 16 and the conductive roller 17. The mainly negatively polarized residual toner passes, without adhering to, the secondary transfer roller 20, the conductive brush 16 and the conductive roller 17. Since the negative polarity voltage is applied to the secondary transfer roller 20, the conductive brush 16 and the conductive roller 17, a current of the negative polarity is applied to the intermediate transfer belt 10 in a circumferential direction thereof. Therefore, a surface potential of the intermediate transfer belt 10 near the photoconductive drums 1*a* to 1*d* is set to be about −300V due to an effect of a Zener diode 15*b*. Further, by charging the photoconductive drum 1*a* with the charging roller 2*a* at a timing at which the front end of the residual toner arrives at the photoconductive drum 1*a*, and setting the potential of the surface of the photoconductive drum 1*a* to be about −500V, the residual toner passes without being collected by the cleaning device on the photoconductive drum 1*a*. Further, the photoconductive drum 1*b* is exposed uniformly by an exposure device 3*b* at a timing at which the front end of the residual toner arrives at the photoconductive drum 1*b*. By setting an exposure amount at this time to be greater than an exposure amount for the photoconductive drum 1*a*, a surface potential of the photoconductive drum 1*b* is uniformly about −100V. Since the toner polarity of the residual toner is negative, the residual toner is completely transferred from the intermediate transfer belt 10 to the photoconductive drum 1*b* by electrostatic force in the primary transfer portion, and is collected by a cleaning device on the photoconductive drum 1*b*.

In this manner, lengths of the first test patch and the second test patch are set to be at least shorter than the distance between the primary transfer position (black) and the secondary transfer roller 20 with respect to the rotational direction of the intermediate transfer belt 10. Further, the residual toner of the first test patch (patch A') and the second test patch (patch B) are formed so as not to overlap each other on the intermediate transfer belt 10. Therefore, the negative polarity voltage may be applied to the secondary transfer roller 20 while the test patches pass the secondary transfer roller 20; thus, soiling of the secondary transfer roller 20 due to secondary transfer of the test patches to the secondary transfer roller 20 may be avoided. Further, an influence of the residual toner of the first test patch exerted on detection output of the second test patch may also be avoided.

In the present embodiment, the number of test patches is two; however, even in a case in which three or more test patches are formed, soiling of the secondary transfer roller 20 by those test patches may be avoided by providing patch formation prohibited areas between adjoining test patches. In the present embodiment, the test patches are described as patterns for color misregistration control; however, the test patches are not limited to the same. For example, in patterns for color density correction, the same effect may be provided by forming test patches under the same conditions as described above. The residual toner may be retransferred to any of the photoconductive drums 1*b* to 1*d*.

Third Embodiment

In the present embodiment, a case in which a pattern for color density correction is formed as a third test patch in addition to a first test patch will be described.

Color Density Correction

Figure 9:
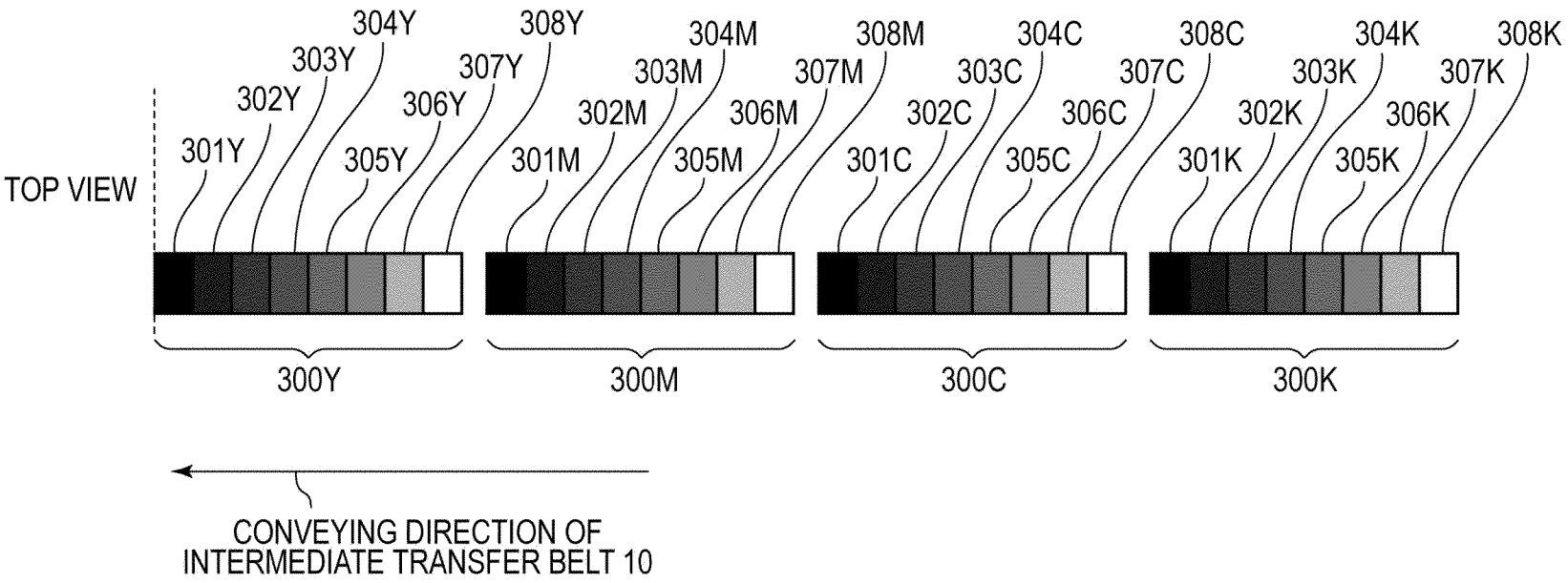
FIG. 9 is a diagram illustrating a pattern for correcting color density as a test patch.

First, color density correction will be described with reference to FIG. 9. FIG. 9 is a diagram illustrating a pattern for color density correction as a test patch. An exemplary pattern for color density correction in the present embodiment is a pattern in which 8-toned halftone patches for yellow, magenta, cyan and black are arranged sequentially. Detection of the pattern for color density correction is performed by using reflected light detected by a light-receiving element 63. The light-receiving element 63 is disposed at a position to detect a specular-reflection component of infrared light emitted from a light-emitting element 61. As the color density of the pattern for color density correction formed on the intermediate transfer belt 10 becomes higher, the amount of infrared light which is diffused or absorbed by toner particles becomes greater; thus, an amount of specular reflected light which may be detected by the light-receiving element 63 is decreased. Therefore, it is possible to calculate the color density on the basis of an amount of reflected light detected by the light-receiving element 63. On the basis of a detection result, color density correction is performed by providing a feedback using a look-up table (LUT).

Next, background detection for the color density correction will be described. Reflected light of the infrared light emitted by the light-emitting element 61 toward the test patch includes light reflected from the toner and light reflected from the intermediate transfer belt 10. The intermediate transfer belt 10 has variation in surface roughness or degree of brilliancy with location; therefore, the amount of reflected light from the intermediate transfer belt 10 varies with the location of the intermediate transfer belt 10. Therefore, in a case in which the test patches of the same tone are formed at different locations on the intermediate transfer belts 10, the amount of reflected light to be detected by the light-receiving element 63 becomes different. Then, as background detection, reflected light from an area of the intermediate transfer belt 10 in which the pattern for color density correction is to be formed is obtained in advance in a state in which there is no pattern for color density correction. Then, by calculating a ratio between the reflected light from the pattern for color density correction and the reflected light from the background, the reflected light from the pattern for color density correction with an influence of the reflected light from the background being removed therefrom may be obtained. Therefore, in the color density correction, it is necessary to move the intermediate transfer belt 10 along its entire circumference at least twice for background detection and for the detection of the pattern for color density correction. In the present embodiment, shortening a time period necessary for calibration by properly controlling positions at which the pattern for color misregistration control and the pattern for color density correction are formed will be described.

Timing Chart of Formation of Test Patches

Figure 10:
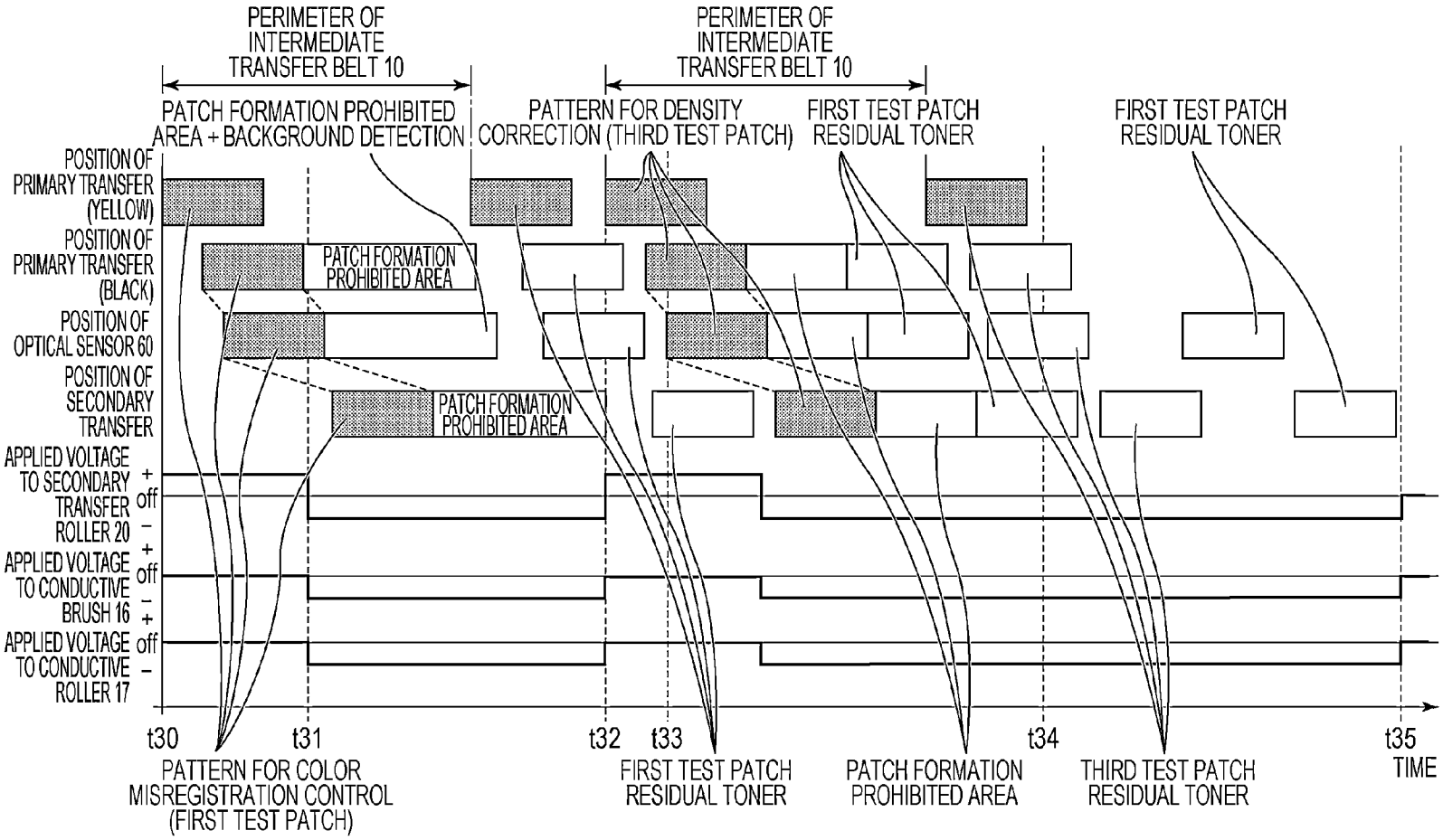
FIG. 10 is a timing chart illustrating a flow in which test patches are formed.

FIG. 10 is a timing chart illustrating a flow in which the test patches are formed. This timing chart illustrates timings at which the first test patch, the patch formation prohibited area and the third test patch pass a primary transfer position (yellow), the primary transfer position (black), a detecting position facing the optical sensor 60, and the secondary transfer position. The timing chart also illustrates timings at which voltages are applied to the secondary transfer roller 20, the conductive brush 16 and the conductive roller 17. Hereinafter, an operation at each timing will be described. Description of the same operations as those described in foregoing FIG. 6 or 8 will be omitted.

t31 is a timing at which a rear end of the first test patch passes the primary transfer position (black) and, at the same time, before a front end of the first test patch arrives at the secondary transfer roller 20. That is, a length of the first test patch is set to be at least shorter than a distance between the primary transfer position (black) and the secondary transfer roller 20 with respect to the rotational direction of the intermediate transfer belt 10. By applying a negative polarity voltage to the secondary transfer roller 20, a conductive brush 16 and a conductive roller 17 at timing t31, it is possible to avoid adhesion of toner of the first test patch to the secondary transfer roller 20. In a patch formation prohibited area after timing t31, the optical sensor 60 performs background detection of the intermediate transfer belt 10 in an area in which the third test patch as the pattern for color density correction is to be formed. Background detection is necessary to precisely measure the toner amount of the third test patch without being influenced by a surface state of the intermediate transfer belt 10. Background detection is measured by detecting a surface state of the intermediate transfer belt 10 in an area corresponding to the third test patch by detecting, by the light-receiving element 63, specular reflected light of infrared light emitted by the light-emitting element 61. An area for background detection is set to include an area on the intermediate transfer belt 10 in which the third test patch is to be formed.

At timing t32, the negative polarity voltage is applied to the secondary transfer roller 20, the conductive brush 16 and the conductive roller 17; thus the first test patch is collected to the photoconductive drum 1*a*. The primary transfer of the third test patch is started at timing t32. Since formation of the third test patch is started after the rear end of the first test patch passes the primary transfer position, the first test patch and the third test patch are formed so as not to overlap each other on the intermediate transfer belt 10.

Next, t33 is a timing immediately before the front end of the third test patch passes the optical sensor 60. The optical sensor 60 turns the light-emitting element 61 on to start emission of infrared light at the timing at which the third test patch arrives at the detection area of the optical sensor 60. Specular reflected light of the infrared light emitted by the light-emitting element 61 and reflected by the third test patch is received by the light-receiving element 63. The third test patch which has passed the optical sensor 60 is collected in a cleaning device on the photoconductive drum 1*a* in the same manner as that of the first test patch. The residual toner remaining on the intermediate transfer belt 10 is collected by the conductive brush 16 and the conductive roller 17; then the sequence is completed.

In this manner, lengths of the first test patch and the third test patch are set to be at least shorter than the distance between the primary transfer position (black) and the secondary transfer roller 20 with respect to the rotational direction of the intermediate transfer belt 10. Further, an interval between the rear end of the first test patch and the front end of the third test patch is set to be at least longer than the distance between the primary transfer position (black) and the secondary transfer roller 20 with respect to the rotational direction of the intermediate transfer belt 10. Therefore, the negative polarity voltage may be applied to the secondary transfer roller 20 while the test patches pass the secondary transfer roller 20; thus, soiling of the secondary transfer roller 20 due to secondary transfer of the test patches to the secondary transfer roller 20 may be avoided. Further, by performing background detection of the third test patch in the patch formation prohibited area after the first test patch is formed, it is possible to perform background detection necessary to detect color density and to perform color misregistration correction on the same circumference of the intermediate transfer belt 10; therefore, time period required for calibration in which detection for color misregistration and color density are performed may be shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-267470, filed Dec. 6, 2012, which is hereby incorporated by reference herein in its entirety.

What is claimed is:

1. An image forming apparatus comprising:

a plurality of image bearing members on which electrostatic latent images are formed;

a plurality of developing units configured to develop each of the electrostatic latent images formed on the image bearing members as a toner image;

an intermediate transfer member;

a primary transfer unit configured to transfer, as primary transfer, the plurality of toner images developed by the developing units to the intermediate transfer member in a plurality of primary transfer portions;

a secondary transfer unit configured to transfer, as secondary transfer, the plurality of toner images which have been transferred as the primary transfer to the intermediate transfer member to a recording material in a secondary transfer portion;

a supply unit configured to supply a common transfer current, to be used for the primary transfer and the secondary transfer, to the primary transfer unit and the secondary transfer unit;

a forming unit configured to form a first test patch and a second test patch formed consecutively thereafter and next to the first test patch with no other test patches formed therebetween, the first and second test patches for correcting color misregistration or color density; and a detecting unit configured to detect the first test patch and the second test patch formed on the intermediate transfer member, wherein a length of the intermediate transfer member in a rotational direction thereof from a rear end of the first test patch to a front end of the second test patch which is formed subsequently to the first test patch with no other test patches formed therebetween the rear end of the first test patch and the front end of the second test patch, is longer than a length of the intermediate transfer member from a primary transfer portion located in the lowermost stream among the plurality of primary transfer portions to the secondary transfer portion.

2. The image forming apparatus according to claim 1, wherein the first test patch and the second test patch are patches for correcting color misregistration, and the first test patch and the second test patch are formed at positions to eliminate nonuniformity in rotational cycles of the plurality of image bearing members or the intermediate transfer member.

3. The image forming apparatus according to claim 1, wherein the first test patch is a patch for correcting color misregistration, the second test patch is a patch for correcting color density, and background detection for forming the second test patch is performed in an area from a rear end of the first test patch to a front end of the second test patch.

4. The image forming apparatus according to claim 1, wherein the first test patch and the second test patch formed on the intermediate transfer member are formed not to overlap each other.

5. The image forming apparatus according to claim 1, further comprising a cleaning unit configured to clean the toner image on the intermediate transfer member, wherein at the time of forming the second test patch, after the first test patch formed on the intermediate transfer member is cleaned by the cleaning unit, the second test patch is formed in an area in which the first test patch has not been formed.

6. The image forming apparatus according to claim 1, wherein the supply unit performs the primary transfer by supplying a transfer current to the intermediate transfer member and performs the secondary transfer by supplying a transfer current to the secondary transfer unit.

7. The image forming apparatus according to claim 1, wherein the supply unit performs the primary transfer by supplying the transfer current to a plurality of the primary transfer units which are disposed to face the plurality of image bearing members and nip the intermediate transfer member, and performs the secondary transfer by supplying the transfer current to the secondary transfer unit.

8. The image forming apparatus according to claim 1, wherein a polarity of a voltage in the primary transfer unit at the time of performing the primary transfer of the first test patch or the second test patch to the intermediate transfer member is reversed from a polarity of a voltage in the secondary transfer unit at the time at which, after the primary transfer of the first test patch or second test patch to the intermediate transfer member, the first test patch or second test patch arrives at the secondary transfer portion.

9. The image forming apparatus according to claim 8, wherein the polarity of the voltage in the secondary transfer unit is reversed after detection of the first test patch or the second test patch by the detecting unit is completed.

10. The image forming apparatus according to claim 1, wherein a polarity of a voltage in the secondary transfer unit at the time at which the first test patch is passing the secondary transfer portion is reversed from a polarity of a voltage in the primary transfer unit at the time at which, after the first test patch passes the secondary transfer portion, the second test patch is transferred as the primary transfer to the intermediate transfer member.

11. An image forming apparatus, comprising:

a plurality of image bearing members on which electrostatic latent images are formed;

a plurality of developing units configured to develop each of the electrostatic latent images formed on the image bearing members as a toner image;

an intermediate transfer member;

a primary transfer unit configured to transfer, as primary transfer, the plurality of toner images developed by the developing units to the intermediate transfer member in a plurality of primary transfer portions;

a secondary transfer unit configured to transfer, as secondary transfer, the plurality of toner images which have been transferred as the primary transfer to the intermediate transfer member to a recording material in a secondary transfer portion;

a supply unit configured to supply a common transfer current, to be used for the primary transfer and the secondary transfer, to the primary transfer unit and the secondary transfer unit used for the transfer;

a forming unit configured to form a first test patch and a second test patch formed consecutively thereafter and next to the first test patch with no other test patches formed therebetween, the first and second test patches for correcting color misregistration or color density; and a detecting unit configured to detect the first test patch and the second test patch formed on the intermediate transfer member, wherein lengths of the first test patch and the second test patch in a rotational direction of the intermediate transfer member are shorter than a length of the intermediate transfer member from a primary transfer portion located in the lowermost stream among the plurality of primary transfer portions to the secondary transfer portion, and a length of the intermediate transfer member in the rotational direction thereof from a rear end of the first test patch to a front end of the second test patch which is formed subsequently to the first test patch with no other test patches formed therebetween the rear end of the first test patch and the front end of the second test patch, is longer than the length of the intermediate transfer member from the primary transfer portion located in the lowermost stream among the plurality of primary transfer portions to the secondary transfer portion.

12. The image forming apparatus according to claim 11, wherein the first test patch and the second test patch are patches for correcting color misregistration, and the first test patch and the second test patch are formed at positions to eliminate nonuniformity in rotational cycles of the plurality of image bearing members or the intermediate transfer member.

13. The image forming apparatus according to claim 11, wherein the first test patch is a patch for correcting color misregistration, the second test patch is a patch for correcting color density, and background detection for forming the second test patch is performed in an area from a rear end of the first test patch to a front end of the second test patch.

14. The image forming apparatus according to claim 11, wherein the first test patch and the second test patch formed on the intermediate transfer member are formed not to overlap each other.

15. The image forming apparatus according to claim 11, further comprising a cleaning unit configured to clean the toner image on the intermediate transfer member, wherein at the time of forming the second test patch, after the first test patch formed on the intermediate transfer member is cleaned by the cleaning unit, the second test patch is formed in an area in which the first test patch has not been formed.

16. The image forming apparatus according to claim 11, wherein a polarity of a voltage in the primary transfer unit at the time of performing the primary transfer of the first test patch to the intermediate transfer member is reversed from a polarity of a voltage in the secondary transfer unit at the time at which, after the primary transfer of the first test patch to the intermediate transfer member, the first test patch arrives at the secondary transfer portion.

17. The image forming apparatus according to claim 16, wherein the polarity of the voltage in the secondary transfer unit is reversed after detection of the first test patch by the detecting unit is completed.

18. The image forming apparatus according to claim 11, wherein a polarity of a voltage in the secondary transfer unit at the time at which the first test patch is passing the secondary transfer portion is reversed from a polarity of a voltage in the primary transfer unit at the time at which, after the first test patch passes the secondary transfer portion, the second test patch is transferred as the primary transfer to the intermediate transfer member.

* * * * *